US006134405A

United States Patent [19]

Zona

[11] Patent Number: 6,134,405

[45] **Date of Patent: *Oct. 17, 2000**

[54] COMBINED CHARGING AND CLEANING BLADE

[75] Inventor: Michael F. Zona, Holley, N.Y.

[73] Assignee: Xerox Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 09/259,424

[22] Filed: Feb. 26, 1999

[51] Int. Cl.[7] ..... G03G 15/22

[52] U.S. Cl. ..... 399/148

[58] Field of Search ..... 399/148, 168, 399/174, 175, 343, 350, 351

[56] References Cited

U.S. PATENT DOCUMENTS

| | | | |
|---|---|---|---|
| 3,660,863 | 5/1972 | Gerbasi | 15/256.51 |
| 4,348,979 | 9/1982 | Daintrey | 118/688 |
| 4,523,833 | 6/1985 | Jones | 355/3 DD |
| 4,637,340 | 1/1987 | Thompson et al. | 118/657 |
| 4,777,904 | 10/1988 | Gundlach et al. | 118/653 |
| 4,901,116 | 2/1990 | Haneda et al. | 355/253 |
| 4,935,784 | 6/1990 | Shigehiro et al. | 355/253 |
| 5,085,171 | 2/1992 | Aulick et al. | 118/653 |
| 5,166,733 | 11/1992 | Eliason | 355/251 |
| 5,749,030 | 5/1998 | Park | 399/148 |
| 5,765,076 | 6/1998 | Ogata et al. | 397/168 |
| 5,809,376 | 9/1998 | Chiesa et al. | 399/111 |

*Primary Examiner*—Robert Beatty
*Assistant Examiner*—Hoang Ngo
*Attorney, Agent, or Firm*—Andrew D. Ryan

[57] ABSTRACT

A member for use in an electrostatographic printing machine is adapted to transfer a charge from a charging source to a surface adapted to receive a latent image. The member is also adapted to clean at least one of marking particles and contamination from the surface.

7 Claims, 12 Drawing Sheets

COMBINED CHARGING AND CLEANING BLADE

BACKGROUND OF THE INVENTION

This invention relates to electrostatographic reproduction machines, and more particularly to the charging and cleaning stations in an electrostatographic reproduction machine. Specifically this invention relates to such an electrostatographic reproduction machine including combined charging and cleaning.

Generally, the process of electrostatographic reproduction, as practiced in electrostatographic reproduction machines, includes charging a photoconductive member to a substantially uniform potential so as to sensitize the surface thereof. A charged portion of the photoconductive surface is exposed at an exposure station to a light image of an original document to be reproduced. Typically, an original document to be reproduced is placed in registration, either manually or by means of an automatic document handler, on a platen for such exposure.

Exposing an image of an original document as such at the exposure station records an electrostatic latent image of the original image onto the photoconductive member. The recorded latent image is subsequently developed using a development apparatus by bringing a charged dry or liquid developer material into contact with the latent image. Two component and single component developer materials are commonly used. A typical two-component dry developer material has magnetic carrier granules with fusible toner particles adhering triobelectrically thereto. A single component dry developer material typically comprising toner particles only can also be used. The toner image formed by such development is subsequently transferred at a transfer station onto a copy sheet fed to such transfer station, and on which the toner particles image is then heated and permanently fused so as to form a "hardcopy" of the original image.

It is well known to provide a number of the elements and components, of an electrostatographic reproduction machine, in the form of a customer or user replaceable unit CRU. Typically such units are each formed as a cartridge that can be inserted or removed from the machine frame by a customer or user. Reproduction machines such as copiers and printers ordinarily include consumable materials such as toner, volume limiting components such as a waste toner container, and life cycle limiting components such as a photoreceptor and a cleaning device. Because these elements of the copying machine or printer must be replaced frequently, they are more likely to be incorporated into a replaceable cartridge as above.

There are therefore various types and sizes of cartridges, varying from single machine element cartridges such as a toner cartridge, to all-in-one electrostatographic toner image forming and transfer process cartridges. The design, particularly of an all-in-one cartridge can be very costly and complicated by a need to optimize the life cycles of different elements, as well as to integrate all the included elements, while not undermining the image quality.

The electrostatographic printing process includes six steps or stations within the printing machine. The first of these steps is the charging step performed at the charging station. The second of these steps is the imaging step performed at the imaging station. The third step is the development step performed at the development station. The fourth step is the transfer step occurring at the transfer station. The fifth step is the fusing step occurring at the fusing station. The sixth step is the cleaning step performed at the cleaning station.

A typical prior art electrostatographic printing machine is shown in FIG. 2 as printing machine 1. The printing machine 1 includes a photoconductive surface in the form as shown as photoconductive drum 2. While the printing machine 1 as shown in FIG. 2 is in the form of a drum, prior art printing machines also include a flexible belt which are supported by rollers (not shown).

The printing machine 1 includes a charging station A at which a latent image is applied to the photoconductive drum 2. The charging station A includes a charge corotron 3 for generating ions to charge the drum 2. The charge corotron 3 may be any corotron capable of applying a charge to the drum 2. For example, the charge corotron 3 may include a wire type corotron.

The printing machine 1 further includes an imaging station B at which an image is formed by exposing light to a portion of the latent image is formed by the charging station A. The imaging station B may be in the form of a light lens imaging station or a raster optical scanner laser type of image station.

The printing machine 1 further includes a development station C where marking particles are utilized to develop the latent image formed by the imaging station B. The development station C may include for example a roller 4 for advancing the marking particles toward the drum 2.

The printing machine 1 further includes a transfer station D at which the developed image from the development station C is transferred to a sheet.

The printing machine 1 further includes a fusing station E at which the developed image is fused to the sheet by fusing rollers 5.

The printing machine 1 further includes a cleaning station F at which the photoconductive drum 2 is cleaned of contamination and residual particles so that the printing machine 1 may be recharged at charging station A. Cleaning station F may, for example, include a detoning roll, a rotating brush or as shown in FIG. 2, include a cleaning blade 6 for removal of the contamination and residual toner particles on the photoconductive drum 2.

An alternative form of a prior art machine as shown as printing machine 1' as shown in FIG. 3. The printing machine 1' includes a photoconductive surface in the form of the photoconductive drum 2. The photoconductive surface may alternatively be in the form of a belt supported by rollers (not shown). The printing machine 1' includes a charging station A' at which a charge is applied to the photoconductive drum 2. For example, the charging station A' may include a biased charge roller 7 which applies the charge to the photoconductive drum 2.

After the photoconductive surface has been charged, the photoconductive surface is exposed at imaging station B'. At imaging station B', the charge surface is exposed to form a latent image. The exposure station may include a light lens system or a raster output scanner laser system.

At development station C', the latent image is developed with marking particles to form the developed image. The marking particles are advanced toward the photoconductive drum 2 by for example a developer roller 8.

At transfer station D', the developed image from the development station C' is transferred to a sheet.

At fusing station E', a set of fusing rolls 9 is utilized to fuse the developed image onto the sheet.

At cleaning station F', the cleaning blade 6 is utilized to remove the excess marking particles and contamination from the photoconductive drum 2 so that the xerographic process can begin anew at charging station A'.

Prior art printing machines such as printing machine 1 of FIG. 2 and printing machine 1' of FIG. 3 require separated apparatus for the charging station and for the cleaning station. The charging station and the cleaning station require expensive hardware as well as significant assembly time and cost. Further, the requirement for separate cleaning and charging systems represents an increase in the development time to develop a xerographic system that will properly operate in the printing machine. Further, the requirement for separate cleaning and charging station results in a large, cumbersome xerographic system. Component size and gravity considerations limit the design flexibility for the printing machine with separate cleaning and charging stations. Further, the cleaning and charging systems each require physical space about the photoconductive surface requiring the xerographic system to become large.

Prior art charging devices are particularly wrought with problems. For example, corotron type of charging devices as shown in FIG. 2 are a significant source of ozone. Attempts have been made to reduce the ozone generated from corotron devices. For example, carbon paper lining may be added to the shield about the corotron or a deep AG coating may be applied to the corotron grid. The carbon paper lining and AG coating serve to reduce the ozone generated in the corotron device. Even with the attempts to reduce the ozone of the corotron, corotrons tend to be a significant source of ozone emission.

The alternate type of charging device is in the form of a bias charge roller. A bias charge roller contacts the photoreceptor and can cause wear to the photoconductive surface.

The following disclosures may be relevant to various aspects of the present invention:

- U.S. Pat. No. 5,166,733 Patentee: Eliason Issue Date: Nov. 24, 1992
- U.S. Pat. No. 5,085,171 Patentee: Aulick, et al. Issue Date: Feb. 4, 1992
- U.S. Pat. No. 4,935,784 Patentee: Shigehiro, et al. Issue Date: Jun. 19, 1990
- U.S. Pat. No. 4,901,116 Patentee: Haneda, et al. Issue Date: Feb. 13, 1990
- U.S. Pat. No. 4,777,904 Patentee: Gundlach, et al. Issue Date: Oct. 18, 1988
- U.S. Pat. No. 4,637,340 Patentee: Thompson, et al. Issue Date: Jan. 20, 1987
- U.S. Pat. No. 4,523,833 Patentee: Jones Issue Date: Jan. 18, 1985
- U.S. Pat. No. 4,348,979 Patentee: Daintrey Issue Date: Sep. 14, 1982
- U.S. Pat. No. 43,660,863 Patentee: Gerbasi Issue Date: May 9, 1972
- U.S. patent application Ser. No. 08/970,313 Applicants: Kumar, et al. Filing Date: Nov. 14, 1997

U.S. Pat. No. 5,166,733 discloses an electrophotographic printer having a photoreceptor surface for the creation of electrostatic latent images thereon and a rotating roll for conveying toner particles to a development zone adjacent the photoreceptor surface, an apparatus prevents the migration of toner particles from the roll. A blade, in contact with the roll adjacent one end thereof, causes toner particles adhering to an area of the roll to be moved toward the roll center as the roll rotates.

U.S. Pat. No. 5,085,171 discloses a doctor blade having an outer metal surface on a grit layer with flexible backing. The blade is pushed by foam or, alternately by inherent resilience, onto a developer roller. The compliance reduces toner variations which result from surface variations of the blade and the roller.

U.S. Pat. No. 4,935,784 discloses an apparatus for developing a latent image on a photo-sensitive drum which apparatus uses as a developing agent microcapsule toner magnetic particles wherein regulation member contacts the surface of developing agent carrier, or sleeve, under pressure for regulating the thickness of a uniform thin layer of the particles deposited on the sleeve and the contact pressure of the regulation member on the sleeve is not more than 20 g/cm. Preferably, the toner particles have a residual magnetic level not more than 4 emu/g and a magnetic holding force not more than 90 Oe.

U.S. Pat. No. 4,901,116 discloses an electrostatic copier having a smoothing member at an upstream side in the developer conveying direction in the vicinity of a developing area between a developer conveyer and an image-forming member in order to smooth a developer layer on the conveyor prior to transfer of the image forming member. Further, one surface of the smoothing member is so arranged as to come in contact with the image-forming member and another surface smoothes the developer layer. The developer conveyer has a magnet member therein and the magnet member is positioned to face the smoothing portion of the smoothing member.

U.S. Pat. No. 4,777,904 discloses a touchdown development system includes a donor roll positioned closely adjacent a photosensitive member in order to develop an image on the surface of the photosensitive member. A reverse mounted doctor blade is employed in the system along with a toner pump in order to apply a smooth and uniform layer of toner onto the surface of the donor roll.

U.S. Pat. No. 4,637,340 discloses a structure for metering the developer to a uniform thickness on a developer roll. To this end a magnetic steel shim or blade member is provided in the vicinity of a magnetic developer roll. The shape and location of the shim or blade member in the developer sump is such that a transport magnet (i.e. developer roll) rotatably supported adjacent the outlet of the sump causes vibration of the shim or blade due to the coupling and decoupling therebetween of the magnetic force fields created through the rotation of the developer roll. The developer which passes between the shim or blade member and the developer roll is freed of agglomerations and is metered to a predetermined thickness on the developer roll.

U.S. Pat. No. 4,558,943 discloses an apparatus in which a latent image recorded on an image receiving member is developed. A developer roller transports the marking particles into the development zone. The developer roller has the exterior surface thereof roughened forming a multiplicity of peaks extending outwardly therefrom with a coating of polymeric material filling the space between adjacent peaks. A blade is positioned to have the free end thereof contacting the peaks on the developer roller. The blade has a plurality of apertures therein through which the marking particles pass. In this way, the thickness of the layer of marking particles on the developer roller is controlled.

U.S. Pat. No. 4,523,833 discloses an apparatus in which a latent image recorded on an image receiving member is developed. A developer roller transports marking particles into the development zone. A blade having at least one aperture therein through which the marking particles pass has the free end portion thereof contacting the developer roller. A controller regulates the quantity of marking particles passing through the aperture in the blade. In this way, the thickness of the layer of marking particles on the developer roller is adjusted.

U.S. Pat. No. 4,348,979 discloses a magnetic brush monocomponent developer unit includes a doctor blade for rendering uniform the layer of toner magnetically attracted to the surface of a shell within which a rotating magnetic roller is positioned. A coil connected to the doctor blade receives an alternating magnetic field in response to rotation of the roller and the induced voltage fluctuations in that coil are sensed to determine when the voltage amplitude exceeds a given threshold value (indicative of a low amount of toner held back by the doctor blade) at which application of toner to the layer by way of a metering roller and sealing brushes is resumed.

U.S. Pat. No. 3,660,863 discloses an elastomeric blade for removing a dry particulate material from a surface to which the particulate material is electrostatically bonded. An edge of the blade is supported in pressure contact against the surface in a cutting tool fashion and relative motion between the blade and the surface produced wherein the edge of the blade moves between the particulate material and the surface to cut or chisel the material from the surface.

U.S. Pat. No. 4,523,833 discloses a process cartridge for use in a printing machine. The process cartridge includes a housing having a first support surface and a second support surface. The housing further includes a first member rotatably secured to the housing at the first support surface and the second support surface. The housing further includes a second member spaced from the first member and rotatably secured to the housing at the first support surface and the second support surface. The housing further includes a first gear operably associated with the first member and rotatable therewith. The housing further includes a second gear operably associated with the second member and rotatable therewith. The first gear and the second gear are positioned adjacent the first support surface.

SUMMARY OF THE INVENTION

In accordance with one aspect of the present invention, there is provided a member for use in an electrostatographic printing machine. The member is adapted to transfer a charge from a charging source to a surface adapted to receive a latent image. The member is also adapted to clean at least one of marking particles and contamination from the surface.

In accordance with another aspect of the present invention, there is provided a cleaning and charging system for use in a electrostatographic printing machine. The system is utilized for transferring a charge from a charging source to a surface adapted to receive a latent image and for cleaning at least one of marking particles and contamination from the surface. The system includes a frame and a member. The member is operably associated with the frame. The member is in contact with the surface. The member is adapted to transfer charge form the charging source to the surface. The member is adapted to clean at least one of marking particles and contamination from the surface.

In accordance with another aspect of the present invention, there is provided a process cartridge for use in an electrostatographic printing machine for developing with marking particles a latent image. The process cartridge includes a housing defining a chamber for storing a supply of marking particles therein. The process cartridge also includes an imaging member operably associated with the housing and includes a surface thereof adapted to receive a latent image. The process cartridge further includes a multifunctional member operably associated with the imaging member for transferring a charge from a charging source to the surface of the imaging member and for cleaning at least one of marking particles and contamination from the surface of the imaging member. The process cartridge also includes an advancing member operably associated with the housing for advancing the marking particles on a surface thereof from the chamber of the housing in a first direction toward the surface of the imaging member.

In accordance with yet another aspect of the present invention, there is provided an electrophotographic printing machine of the type including a cleaning and charging system. The system is utilized for transferring a charge from a charging source to a surface adapted to receive a latent image and for cleaning at least one of marking particles and contamination from the surface. The system includes a frame and a member. The member is operably associated with the frame. The member is in contact with the surface. The member is adapted to transfer charge form the charging source to the surface. The member is also adapted to clean at least one of marking particles and contamination from the surface.

In accordance with yet another aspect of the present invention, there is provided a method for developing with marking particles a latent image. The method includes the steps of applying a charge to a surface of an imaging member with a multifunctional member, forming a latent image on the surface, developing the latent image to from a developed image, transferring the developed image onto a substrate, and cleaning the surface of the imaging member with the multifunctional member.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention.

Figure 1:
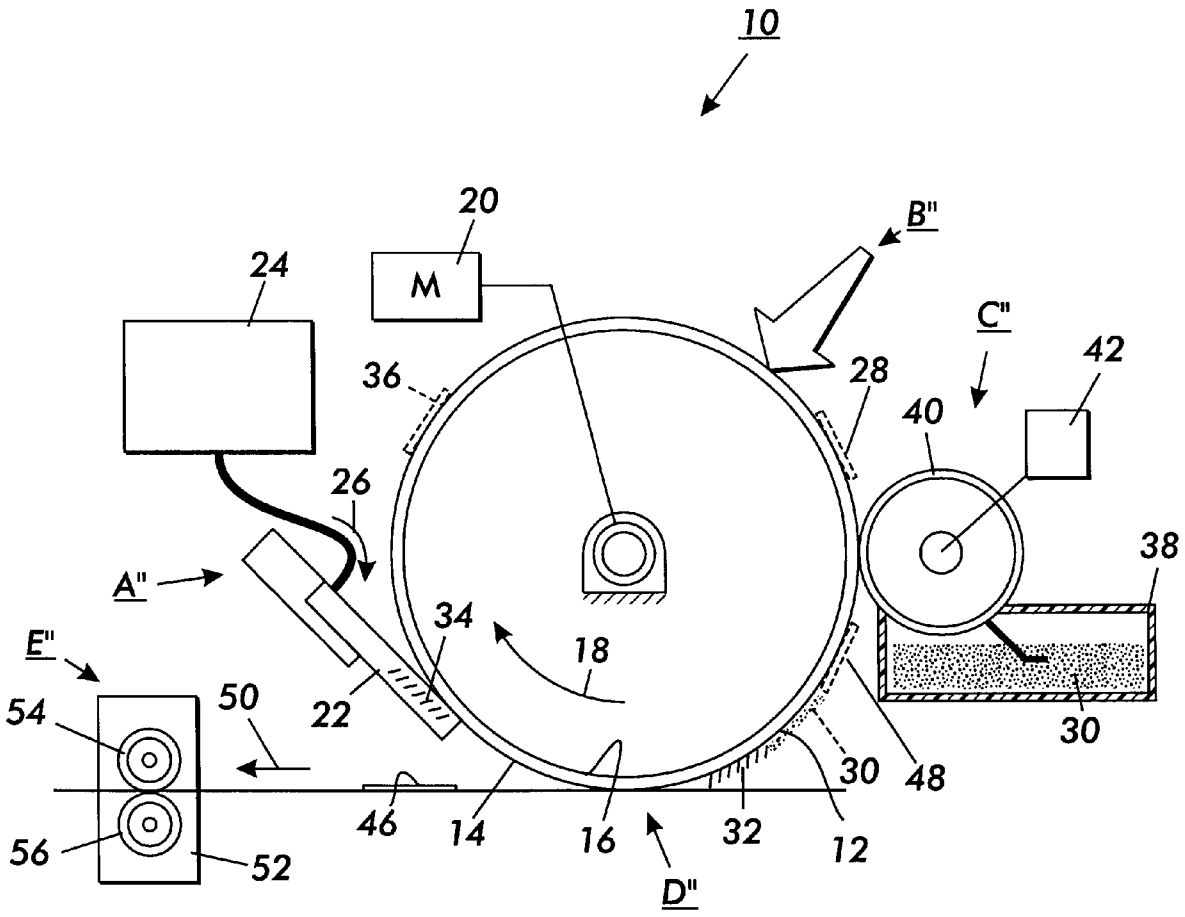
FIG. 1 is a schematic view of an electrophotographic printing apparatus utilizing the combined charging and cleaning blade according to the present invention.
Figure 2:
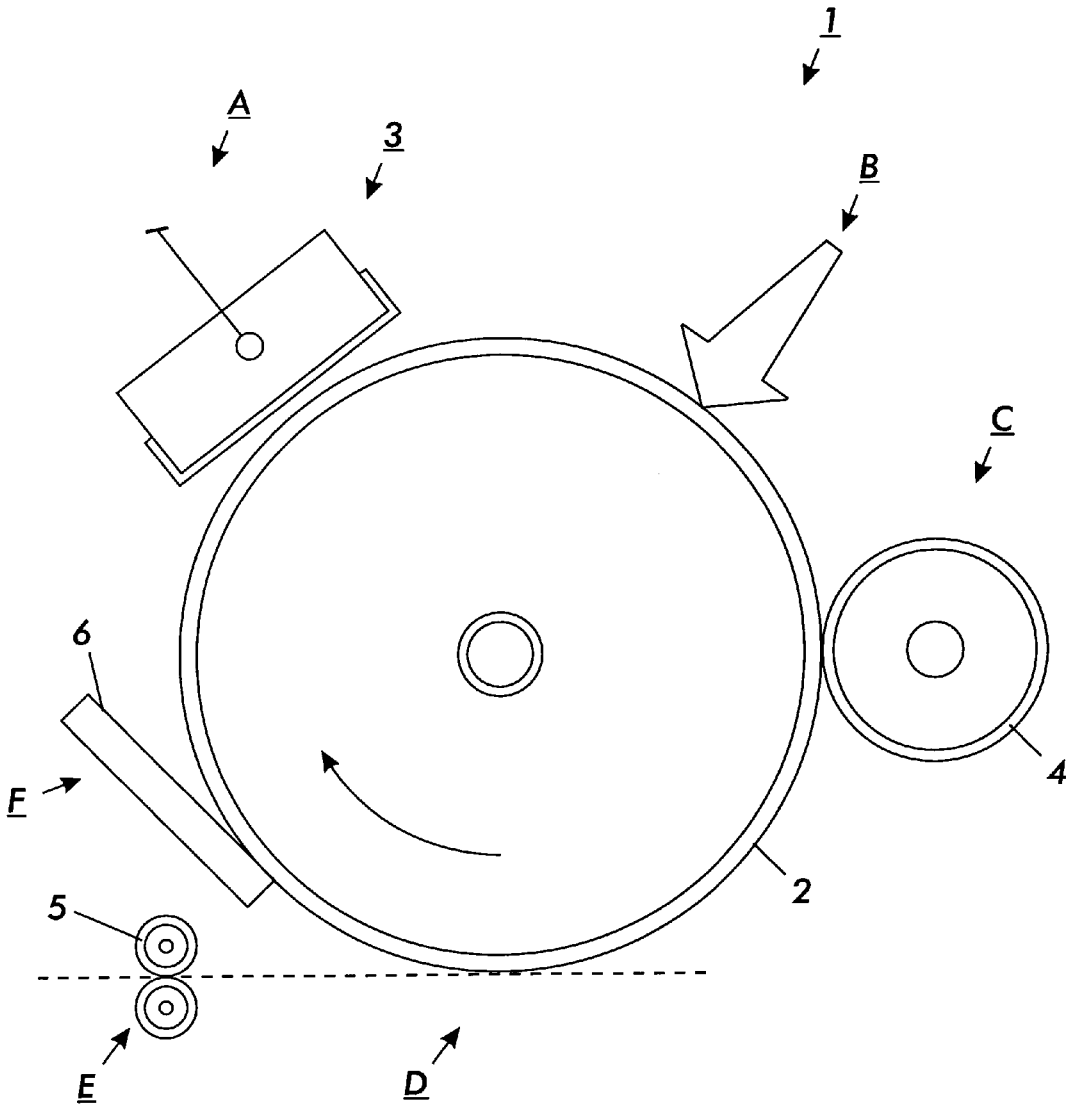
FIG. 2 PRIOR ART
FIG. 2 is a schematic view of a prior art electrophotographic printing apparatus utilizing a charge corotron for charging and a separate cleaning blade for cleaning.
Figure 3:
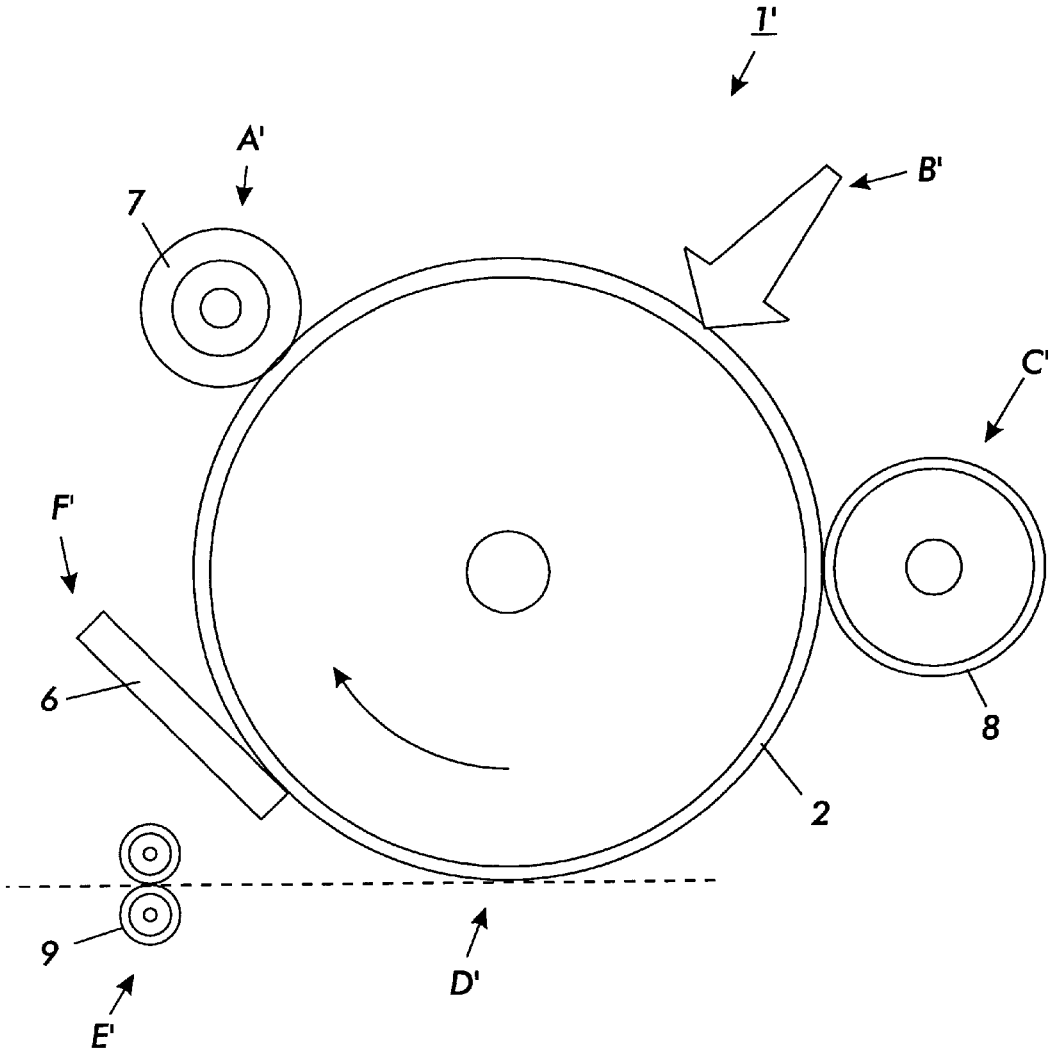
FIG. 3 PRIOR ART
FIG. 3 is a schematic view of another prior art electrophotographic printing apparatus utilizing a biased charging roller for charging and a separate cleaning blade for cleaning.

Referring now to FIG. 1, a printing machine 10 is shown incorporating the combined charging and cleaning blade of the present invention. The electrophotographic printing machine shown employs a photoconductive drum 12 although photoreceptors in the form of a belt are also known, and may be substituted therefor. The drum 12 has a photoconductive surface 14 deposited on a photoconductive substrate 16. The drum 12 moves in the direction of arrow 18 to advance successive portions of the drum 12 sequentially through the various processing stations disposed about the path of movement of the drum 12. A motor 20 rotates the drum 12 to advance the drum 12 in the direction of arrow 18. The drum 12 is coupled to the motor 20 by any suitable means such as a drive.

Initially successive portions of the drum 12 pass through the charging station A". At charging station A", a combined charging and cleaning member 22 according to the present invention is utilized. The cleaning and charging member 22 serves to charge the drum 12 to a selectively high uniform electrical potential, preferably negative. Any suitable power source, well known in the art, for example, charging source 24 may be employed for controlling the charge being applied by the cleaning and charging member 22. The cleaning and charging member 22 is adapted to transfer a charge 26 from the charging source 24 to photoconductive surface 14 on the photoconductive member 12. The photoconductive surface 14 is adapted to receive a latent image 28. The combined cleaning and charging member 22 is adapted to clean at least one of marking particles 30 or contamination 32 from the photoconductive surface 14 of the drum 12.

While the member 22 may have any suitable size and shape and be made of any suitable configuration capable of cleaning at least one of the marking particles 30 and the contamination 32, preferably, the member 22 is in the form of a blade. To assure that the charge 26 from the charging source 24 is transferred to the surface 14 of the drum 12, preferably, at least a portion of the blade 22 includes an electrically conductive material. For example, for simplicity, to minimize wear upon the surface 14, and to reduce cost, the portion of the blade 22 which contacts the surface 14 of the drum 12 is made of a plastic.

While any suitable durable plastic may be utilized for the portion of the blade which contacts the surface 14 of the drum 12, preferably, the blade 22 is made of a urethane. Preferably, to assure that the charge 26 from the charging source 24 is efficiently applied by the blade 22 to the surface 14 of the drum 12, preferably, the portion of the blade 22 through which the charge 26 passes preferably includes an additive 34 to assist in the conduction of electricity. The additive 34 may be any suitable material capable of improving the electrical conductivity of the blade 22. For example, the additive 34 may be in the form of carbon fibers which are mixed with the material from which the blade 22 is molded.

The member 22 transfers the charge 26 from the charging source 24 to form a charged surface 36 on the periphery 14 of the drum 12. As the drum 12 rotates in the direction of arrow 18, the charge surface 36 advances from the charging station A" to the imaging station B". At imaging station B", the charge surface 36 is partially exposed to form the latent image 28. The imaging station B" may be in the form of a light lens system including a light source and a series of mirrors and lenses (not shown) such that a document (not shown) may be illuminated to selectively discharge a portion of the charge surface 36. It should be appreciated that the printing machine may be a digital printing machine. In a digital printing machine, a raster optical scanner (ROS) may lay out the image in a series of horizontal scan lines with each line having a specific number of pixels per inch. The ROS may include a laser (not shown) having a rotating polygon mirror block associated therewith. The ROS exposes the photoconductive surface of the printer.

As the drum 18 rotates further in the direction of arrow 18, the latent image 28 is advanced into the development station C". At development station C", a magnetic development system or unit generally indicated by reference numeral 38 advances marking particles 30 into contact with the latent image 28 on the drum 12. For example, and as shown in FIG. 1, the magnetic developer unit 38 includes a device such as magnetic roller 40 for advancing the marking particles 30 toward the drum 12. Thus, the developer unit 38 contains a magnetic roller 40. Appropriate developer biasing to assist in the transfer of the marking particles from the developer roll to the latent image 28 may be accomplished via a power supply 42 electrically connected to the developer unit 38.

The developer unit 38 develops the charged image areas of the latent image 28 of the photoconductive surface 14. The developer unit 38 contains for example magnetic black toner, for example, marking particles 30 which are charged by the electrostatic field existing between the photoconductive surface 14 and the electrically biased developer roll 40 in the developer unit 38.

A sheet of support material 46 is moved into contact with developed image 48 at transfer station D". The sheet 46 is advanced to the transfer station D" by a suitable sheet feeding apparatus (not shown). For example, the sheet feeding apparatus includes a feed roll (not shown) contacting the uppermost sheet of a stack copy sheet. Feed rolls rotate so as to advance the uppermost sheet from the stack into a chute which directs the advancing sheet of support material into contact with the photoconductive surface of the drum 12 in a time sequence so that the developed image 48 developed thereon contacts with the advancing sheet 46 of support material at the transfer station D".

Transfer station D" may, for example, include a charging device such as a corona charging device (not shown) which may spray ions of a suitable polarity onto the backside of the sheet 46. The ions attract the developed image 40 from the drum 12 and transfer it to the sheet 46. After transfer, the sheet continues to move in the direction of arrow 50 onto a conveyor (not shown) which advances the sheet to a fusing station E".

The fusing station E" includes for example a fuser assembly 52 which permanently affixes the transferred developed image 48 to the sheet 46. For example, the fuser assembly 52 comprises a heated fuser roll 54 and a pressure roll 56.

The sheet 46 passes between the fuser roll 54 and the pressure roll 56 with the developed image 48 contacting the fuser roll 54. In this manner, the toner image is permanently affixed to the sheet 46. After fusing, a chute (not shown) guides the advancing sheet 46 to a catch tray (not shown) for subsequent removal from the printing machine 10 by the operator. It should also be understood that other post fusing operations can be included, for example, stapling, binding, inverting and returning the sheet for duplexing and the like.

After the sheet of support material 46 is separated from the photoconductive surface of the drum 12, residual marking particles 30 and contamination 32 carried by the image and non-image areas on the photoconductive surface 14 must be removed from the photoconductive surface 14 of the drum 12 so that the electrophotographic process may be repeated.

The marking particles 30 and contamination 32 are removed at charging and cleaning station A". The member 22 which is also used to apply the charge to the photoconductive surface 14 is utilized to remove the residual marking particles 30 as well as contamination 32 from the photoconductive surface 14 of the drum 12. The residual particles and contamination 32 are thus scrapped by the member 22 from the drum 12 and then deposited into a waste container (not shown). Simultaneously with the cleaning, the photoconductive surface 14 is recharged to repeat the electrophotographic process.

Figure 9:
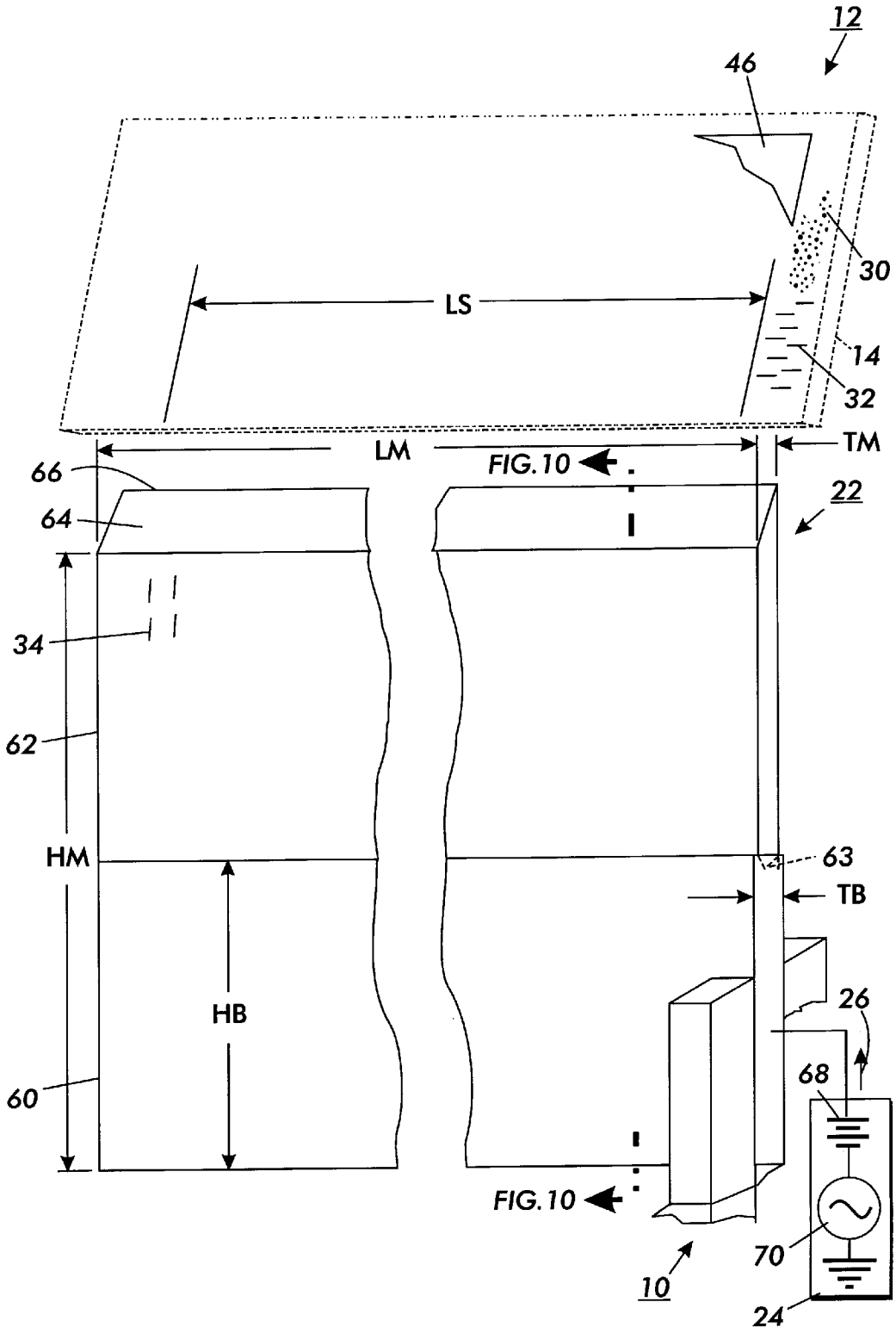
FIG. 9 is a partial perspective view of the two stage charging and metering of the combined charging and cleaning blade according to the present invention.

Referring now to FIG. 9, a cleaning and charging member 22 is shown in greater detail. As shown in FIG. 9, the member 22 is in the form of a blade. It should be appreciated, however, that the member 22 may have any suitable shape capable of contact with the photoconductive surface 14 of the drum 12.

As shown in FIG. 9, the member 22 is preferably in the form of a blade. The blade 22 may have any suitable shape capable of providing contact with the photoconductive member 12. For example, and as shown in FIG. 9, the blade 22 has a generally rectangular shape with a length LM and a height HM. The blade 22 also has a thickness TM. Preferably, as shown in FIG. 9, the length LM of the blade 22 is equal to or greater than the length LS of the developed image 40. By providing the blade 22 with a width LM greater than the developed image 40, the blade 22 may both charge the surface 14 of the photoconductive member 12 as well as clean the marking particles 30 and the contamination 32 from the entire usable width of the photoconductive member 12. For a printing machine having the capability of printing sheets having a length of 11 inches, preferably, the length LS is approximately 11 inches with the length LM being slightly larger than the length LS.

The blade 22 may have any suitable height and thickness capable of providing the proper flexibility for the blade 22 so that it may properly engage and contact the photoconductive member 12 to transfer the charge thereto and to have sufficient contact with the surface 14 of the member 12 such that the contamination 32 and marking particles 30 may be removed from the surface 14 of the member 12. For example, the blade 22 may have a height HM of from 10 to 15 millimeters and a thickness TM of approximately 1 to 3 millimeters. It should be appreciated that the hardness and the modulus of the blade material will affect the proper height and thickness of the blade.

While the blade 22 may be made intricately from a single component, preferably, the blade 22 includes two components. As shown in FIG. 9, the blade 22 includes a conductive body 60 and a flexile tip 62 extending outwardly from the conductive body 60. The conductive body 60 serves to support the flexible tip 62 of the blade 22 and serves to transfer the charge 26 from the charging source 24 to the flexible tip 62. The conductive body 62 has any suitable shape and may for simplicity have a generally rectangular shape. The conductive body 62 may have a height HB of, for example, one half to three inches, and may have a thickness TB of, for example, 0.05 to 0.25 inches.

The conductive body 60 may be secured to the flexible tip 62 in any suitable fashion. For example, the conductive body 60 may be secured to the flexible tip 62 by fasteners or as shown in FIG. 9 being secured to the tip 62 by means of an adhesive 63 applied between the body 60 and the tip 62. The adhesive 63 may be any suitable adhesive, for example, a glue.

The flexible body 60 may be made of any suitable durable material and may for example be made of an electrically conductive material, for example, a metal, such as aluminum. The flexible tip 62 may be made of any suitable material for example, an electrically conductive plastic. For example, the flexible tip 62 may be made of a urethane including additives 34 in the form of carbon fibers or salt to assist in the electrical conductivity of the tip 62. The tip 62 may include an inclined surface 64 having a distal edge 66 thereof. The edge 66 serves to be in contact with the photoconductive member 12 to remove the marking particles 30 and contamination 32 therefrom.

The charging source 24 may be any source capable of providing a charge to the photoconductive surface 14 of the photoresistive member 12. For example, the charging source 24 may include a direct current source 68 as well as an alternating current source 70. The alternating current source 70 may have a voltage of 1000 to 2000 volts alternating current. The direct current source may have a bias of for example 50 to 500 volts.

Figure 10:
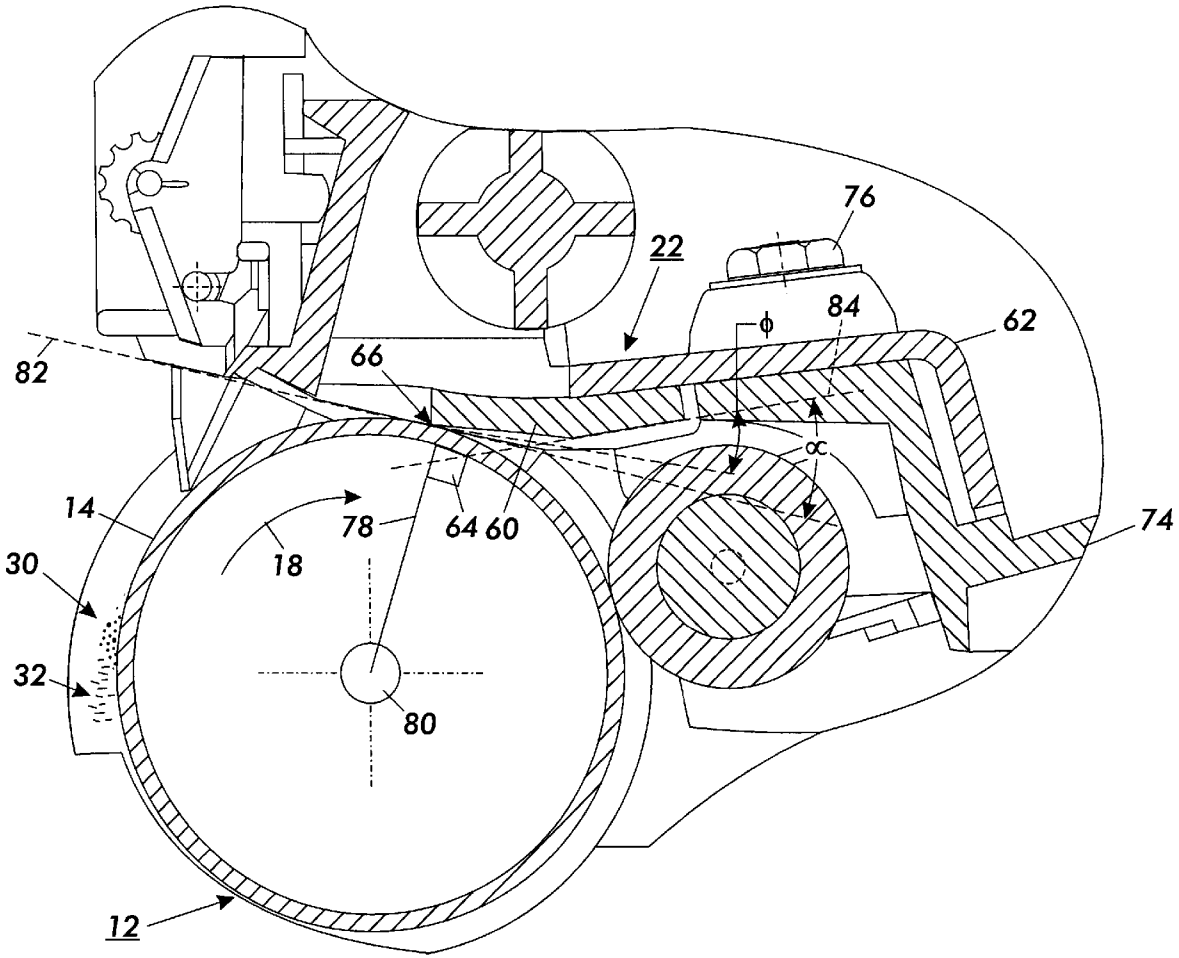
FIG. 10 is a cross sectional view along the line 10—10 in the direction of the arrows of the combined charging and cleaning blade of FIG. 9.

Referring now to FIG. 10, the blade 22 is shown in contact with the drum 12. The body 60 of the blade 22 may be mounted in the printing machine 10 in any suitable fashion. For example, the body 60 of the blade 22 may be mounted to frame 74 of the printing machine 10. For example, the body 60 may be secured to the frame 74 by fasteners such as screws 76. The flexible tip 62 of the blade 22 is positioned relative to the drum 12 such that residual particles 30 and contaminants 32 positioned on the surface 14 of the drum 12 may be removed as the drum 12 rotates in the direction of arrow 18.

For example, the distal surface 64 of the flexible tip 62 of the blade 22 may be positioned generally parallel with the surface 14. The edge 66 of the tip 62 thus may contact the surface 14 of the drum 12 scrapping or removing the contaminants 32 and residual particles 30 from the surface 14.

For example, the blade 22 may be positioned relative to the drum 12 such that edge 66 of the blade 22 is positionable with respect to the surface 14 such that line 78 through the edge 66 and centerline 80 of the drum 12 is perpendicular to tangent line 82 tangent to the surface 14 of the drum 12 at edge 66. The line 84 along the blade 22 may be positioned at an angle $\alpha$ of for example 10 to 50 degrees between the line 84 and the tangent line 82. To provide clearance between the surface 14 and the surface 64 of the blade 22, preferably, the surface 64 defines an angle $\phi$ between the surface 64 and line 84 which is less than the angle $\alpha$.

Certain components within a printing machine tend to wear or require replacement of the printing machine. Such items typically include components which are utilized during the printing process such as the marking particles, the substrate or paper sheets, as well as, certain components that tend to wear during the printing process. Such wear items include the photoconductive surface or drum as well as the cleaning blade and other similar components. Recently, such consumable and wear components are combined into a subsystem which is removable from the printing machine so that the replacement of the consumable and wear items may be readily performed by the machine operator.

Figure 8:
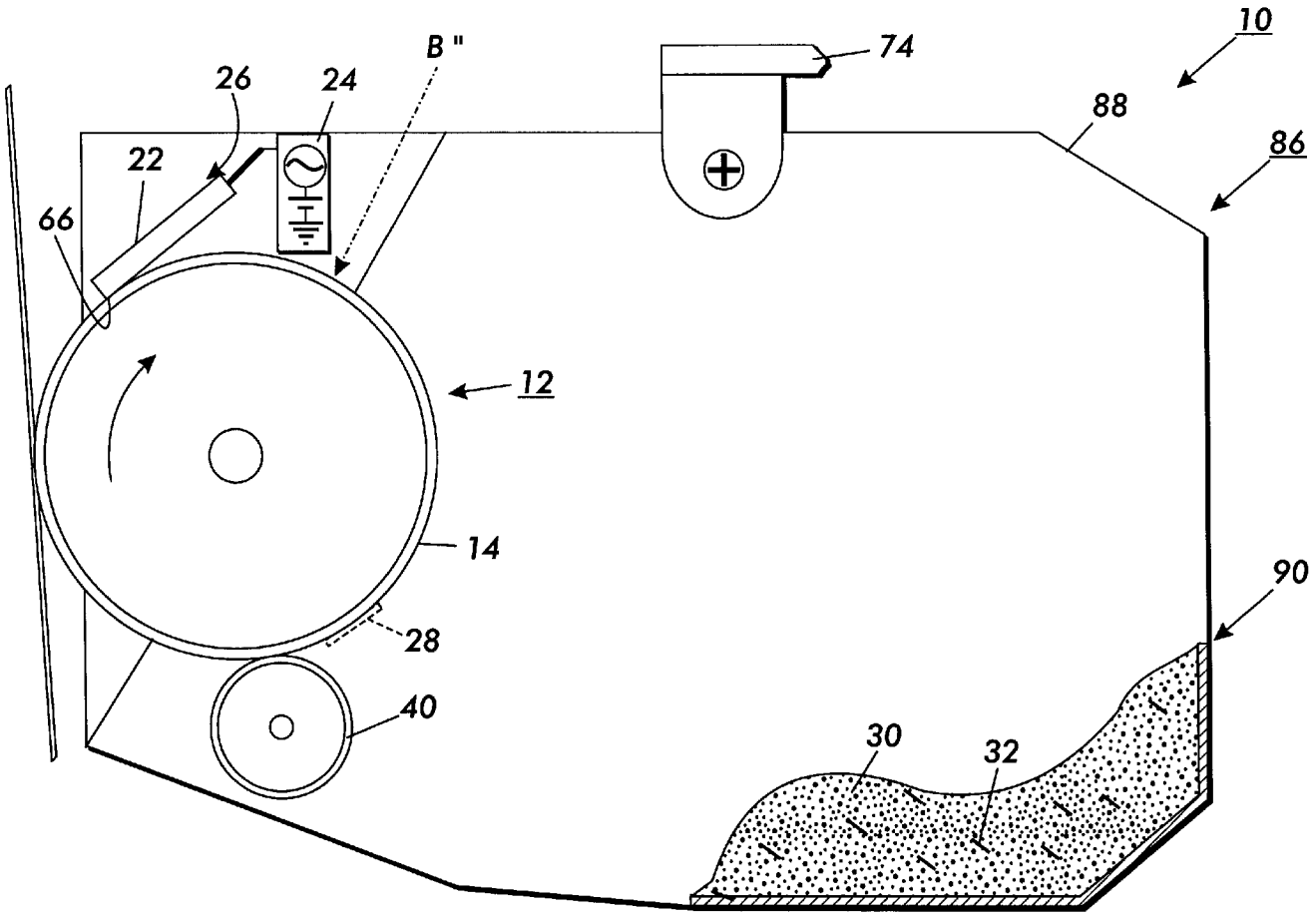
FIG. 8 is a plan view of a process cartridge module utilizing the combined charging and cleaning blade according to the present invention.

Referring now to FIG. 8, one such subsystem is shown in the form of a process cartridge 86. The process cartridge 86 is utilized in the printing machine 10 for developing with the marking particles 30 a latent image 28. The process cartridge 86 includes a housing 88 which defines a chamber 90 for storing a supply of marking particles 30 therein. The process cartridge 86 further includes an imaging member in the form of a drum 12 which is operably associated with the housing 88. For example, the drum 12 may be rotatably mounted to the housing 88. The drum 12 includes a surface 14 which is adapted to receive a latent image 28.

The process cartridge further includes a multi-functional member 22 in the form of the blade 22. The blade 22 is operably associated with the drum 12. For example, the blade 22 includes an edge 66 which is contactable with the surface 14 of the drum 12. The blade 22 has at least two functions. The first function is to transfer a charge 26 from the charging source 24 to the surface 14 of the drum 12. The second function of the blade 22 is to clean the marking particles 30 and contamination 32 from the surface 14 of the drum 12.

The process cartridge 86 further includes an advancing member in the form of a developer roll 40. The developer roll 40 is operably associated with the housing 88 and may be rotatably mounted thereto. The advancing member 40 is utilized to advance the marking particles 30 toward the surface 14 of the drum 12.

It should be appreciated that the charging source 24 may be integral with the process cartridge 86 or may be a component separate from the process cartridge 86.

Figure 11:
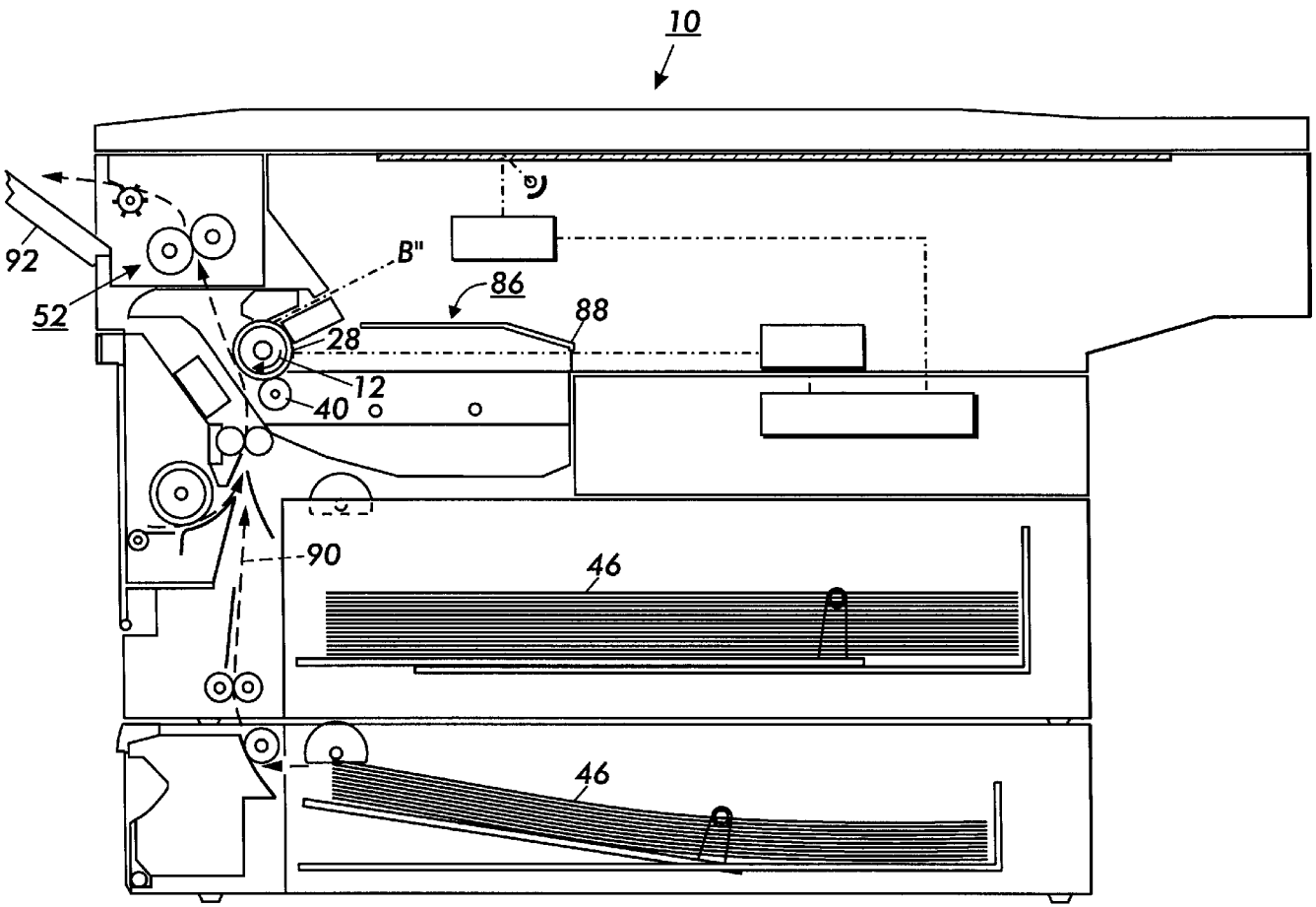
FIG. 11 is a front vertical illustration of an exemplary compact electrostatographic reproduction machine utilizing the combined charging and cleaning blade in accordance with the present invention.

Referring now to FIG. 11, the printing machine 10 is shown. The printing machine 10 utilizes the process cartridge 86 of FIG. 8. Sheets 46 progress along paper path 90. Latent image 28 is formed at image station B" and developed at developer roll 40 within the process cartridge 88. The developed image is transferred to the sheets 46 which progress toward fuser assembly 52 where the developer material is fused to the sheets 46 and progress toward output tray 92.

Figure 12:
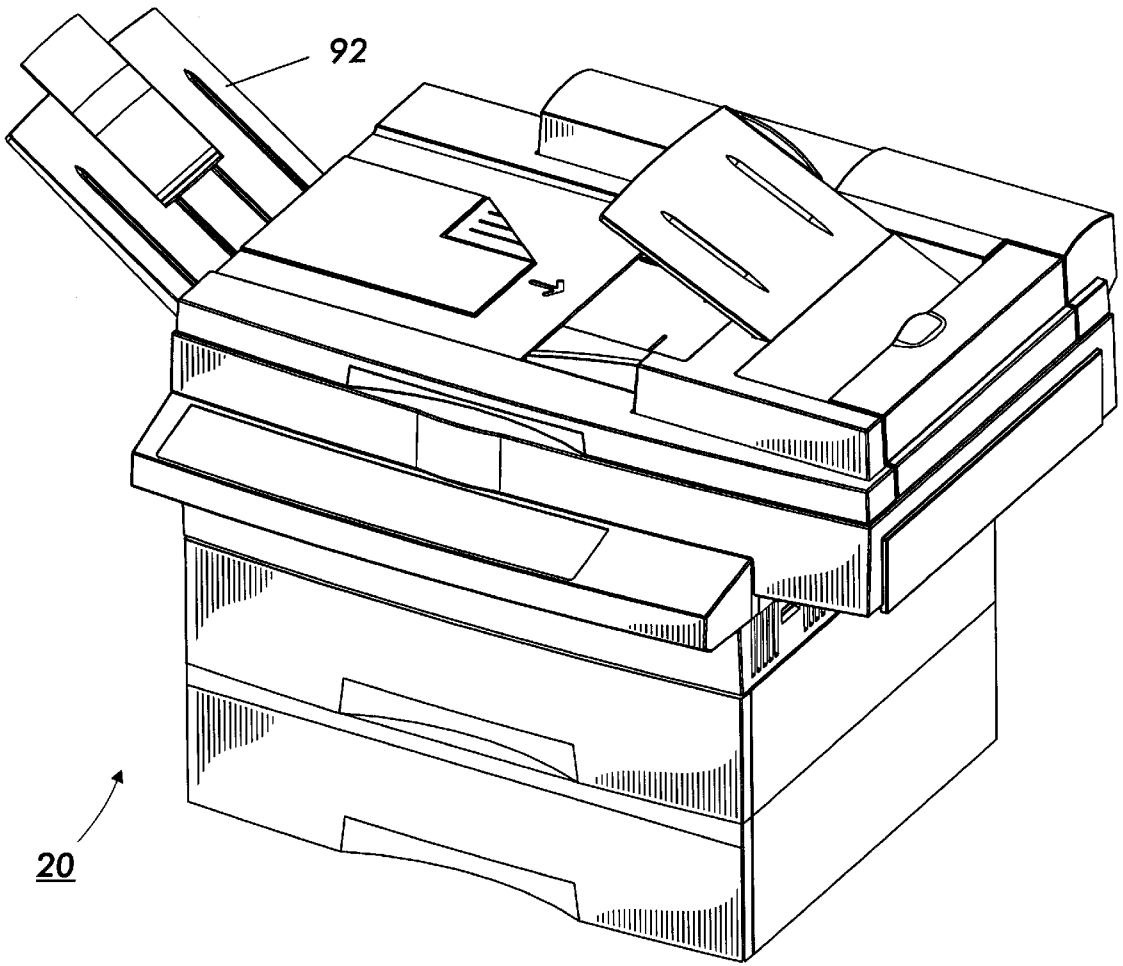
FIG. 12 is a perspective view of the machine of FIG. 11.

Referring now to FIG. 12, the printing machine 10 is shown with the output tray 92 in greater detail.

Figure 5:
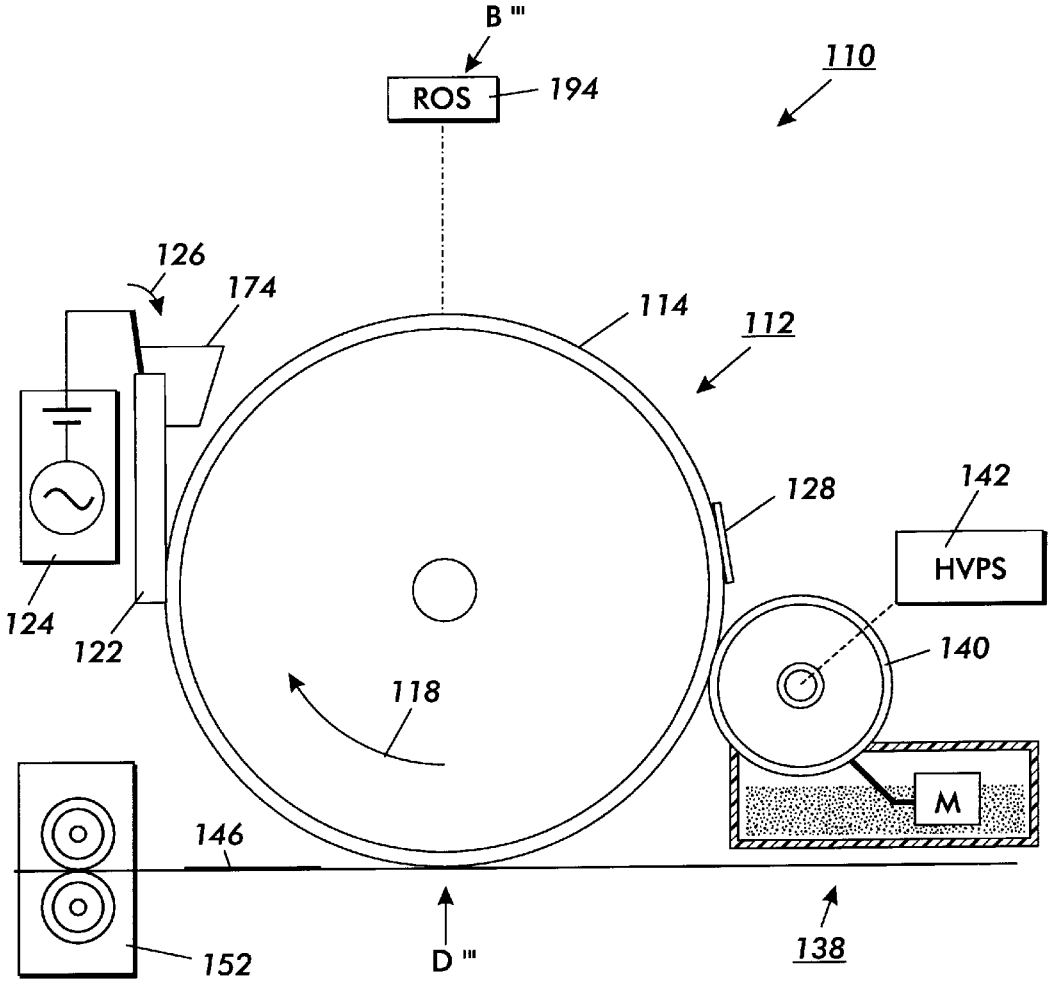
FIG. 5 is a schematic view of an electrophotographic printing machine with a raster output scanner for exposure and a photoconductive drum, the machine utilizing the combined charging and cleaning blade according to the present invention.

Referring now to FIG. 5, an alternate embodiment of a printing machine according to the present invention is shown as printing machine 110. Printing machine 110 utilizes the combined charging and cleaning blade 122 which is similar to cleaning blade 22 of FIG. 1. The drum 112 which is similar to drum 12 of the printing machine 10 of FIG. 1, rotates in the direction of arrow 118. A latent image 128 is formed on surface 114 of the drum 112 at the imaging station B'". As shown in FIG. 5, the imaging station B'" is that of a printing machine which represents a digital machine. In a digital printing machine, a ROS 194 (raster output scanner) lays out an image in a series of horizontal scan lines with each line having a specific of pixels per inch. The ROS may include a laser (not shown) having a rotating polygon mirror block associated therewith. The ROS exposes the photoconductive surface 114 of the drum 112.

The latent image 128 is developed at the developing unit 138. The developing unit 138 includes a developer roll 140 which is biased by a high voltage power supply 142. A sheet 146 is positioned adjacent the drum 114 at transfer station D'". The sheet 146 with the developed image transferred thereto passes through fuser assembly 152 where the image is fused onto the sheet 146. After the developed image has been transferred at transfer station D'", marking particles 130 and contamination 132 remaining on the surface 114 of the drum 112 are removed therefrom by the blade 122. The blade 122 simultaneously transfers charge 126 from the charging source 124 to the surface 114 of the drum 112 to repeat the xerographic process.

Figure 6:
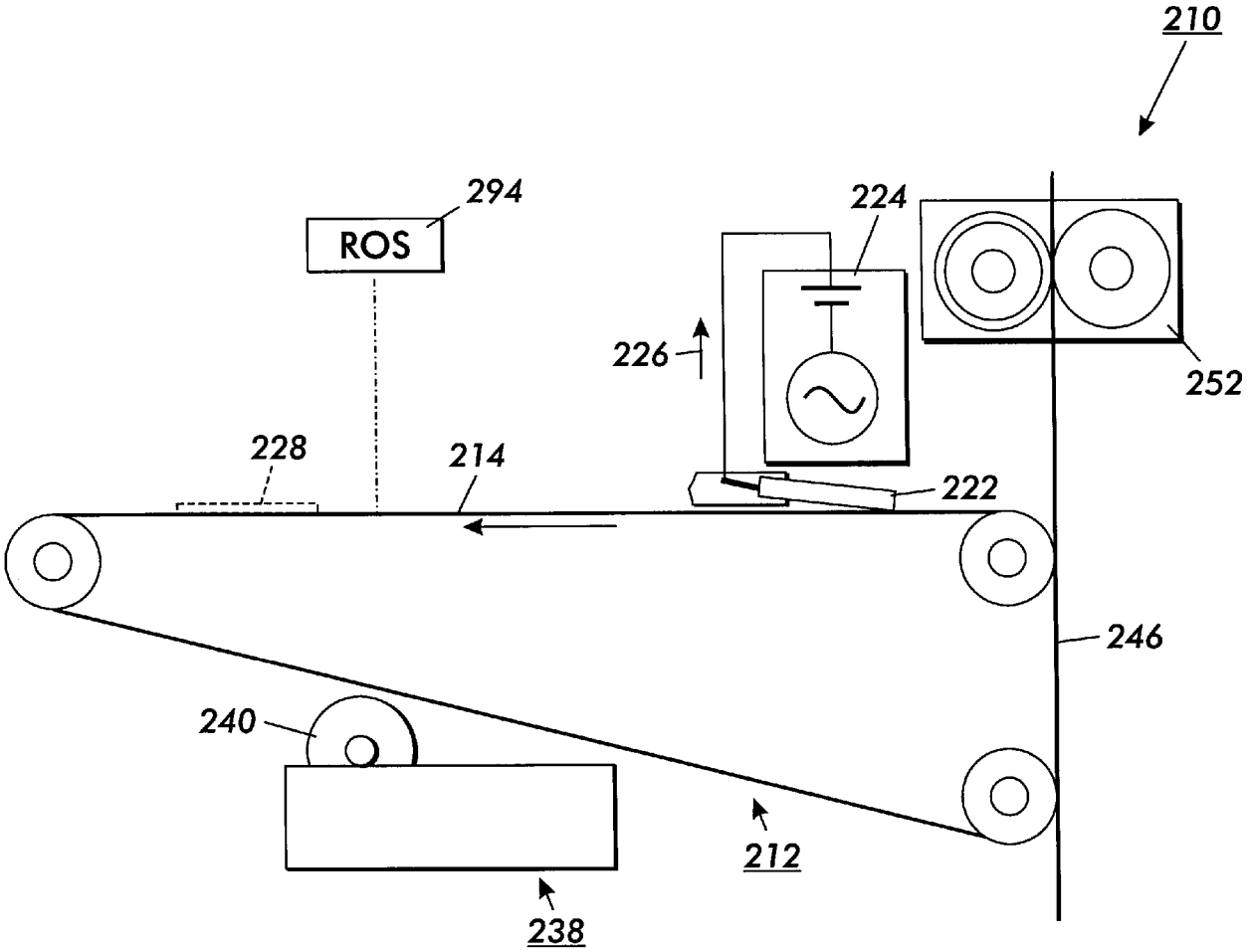
FIG. 6 is a schematic view of an electrophotographic printing machine with a raster output scanner for exposure and a photoconductive belt, the machine utilizing the combined charging and cleaning blade according to the present invention.

Referring now to FIG. 6, an alternate printing machine 210 is shown. The printing machine 210 is similar to the printing machine 110 of FIG. 5, except that rather than having the drum 112 of the printing machine 110, the printing machine 210 includes a belt 212. The belt 212 includes a surface 214 thereof which is photoconductive. A latent image 228 is developed by raster optical scanner 294. The latent image 228 is developed by the developer roll 240 at developer unit 238. The developed image is transferred onto sheet 246 and fused by fuser assembly 252.

The belt 212 is cleaned and recharged by cleaning and charging member 222 which is similar to cleaning member 122 of FIG. 5. The charging member 222 obtains a charge 226 from the charging source 224 and transfers it onto the surface 114 of the belt 212.

Figure 4:
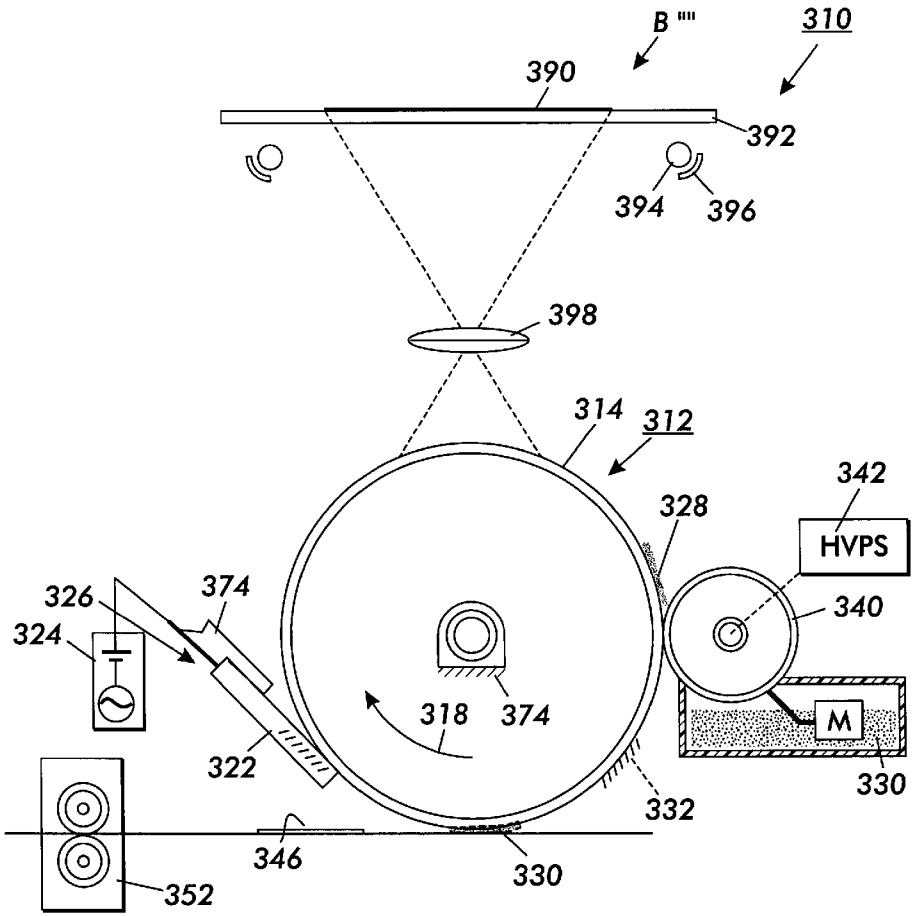
FIG. 4 is a schematic view of an electrophotographic copying machine utilizing the combined charging and cleaning blade according to the present invention.

Referring now to FIG. 4, an alternate printing machine 310 is shown utilizing a charging and cleaning blade 322 according to the present invention. The blade 322 is similar to blade 222 of FIG. 6 and blade 122 of FIG. 5. The blade 322 transfers charge 326 from charging source 324. The blade 322 is mounted to frame 374 of the printing machine 310. The drum 312 rotates in the direction of arrow 318. A document 390 to be reproduced is placed on platen 392 located at the image station B'" where it is illuminated in a known manner by a light source such as tungsten halogen lamp 394. The document 390 which is thus exposed is imaged onto the drum 312 by a system of mirrors 396 and lenses 398 as shown. The optical image selectively discharges the surface 314 of the drum 312 in an image configuration whereby an electrostatic latent image 328 of the original document is recorded on the drum 312.

The latent image 328 is developed by developer roll 340 by marking particles 330. The marking particles are urged from roll 340 toward the latent image 328 by high voltage power supply 342. Contamination 332 and marking particles 330 are removed from surface 314 of the drum 312 after the developed image has been transferred to sheet 346 and simultaneously the surface 314 of the drum 312 is charged by blade 322. The sheet 346 is fused at fuser station 352. The contamination 332 and marking particles 330 are removed from the surface 314 of the drum 312 by blade 22 thereby completing the xerographic process.

Figure 7:
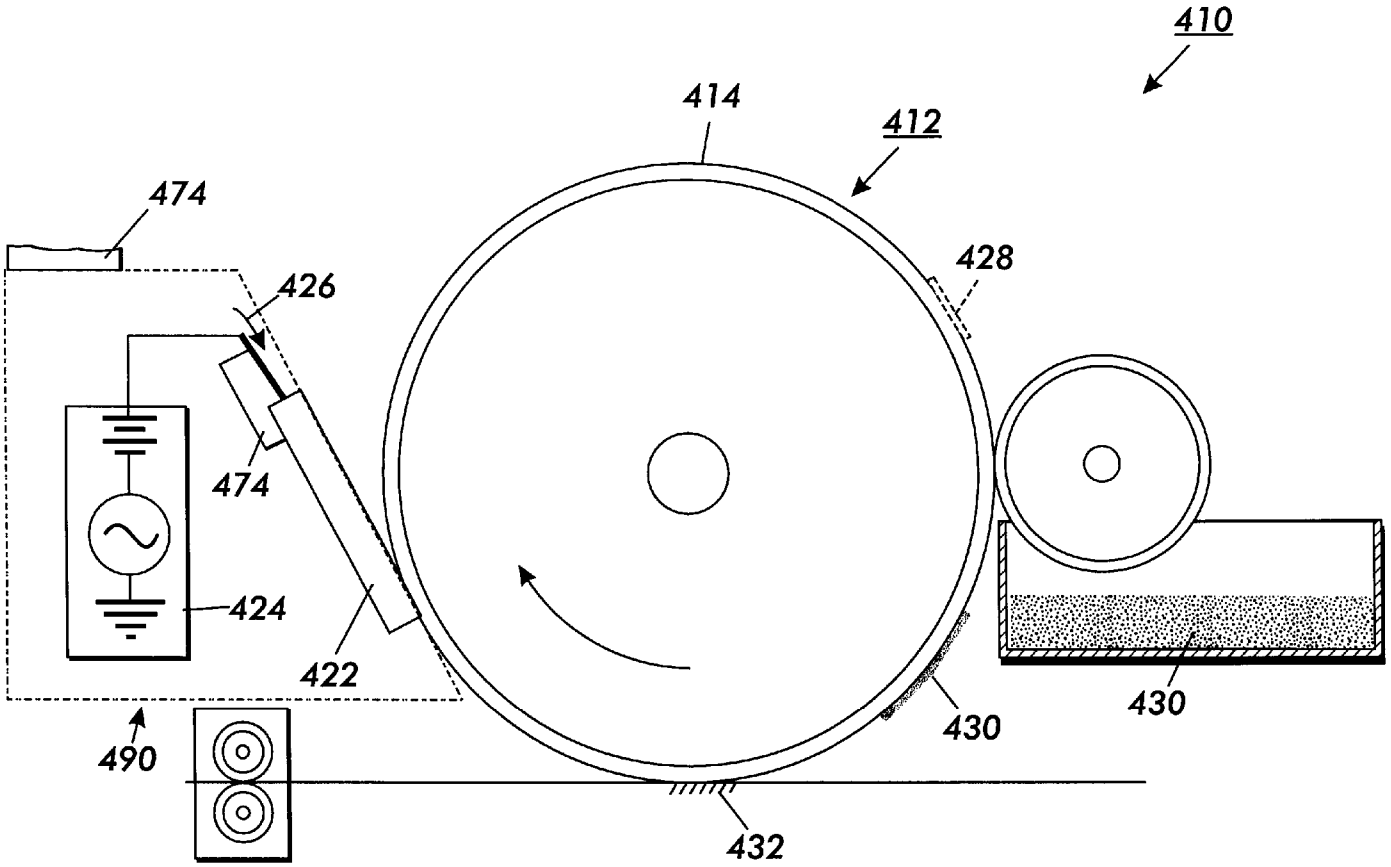
FIG. 7 is a schematic view of a charging and cleaning system for use in an electrophotographic printing machine, the charging and cleaning system utilizing the combined charging and cleaning blade according to the present invention.

Referring now to FIG. 7, a cleaning and charging system 490 for use in the xerographic printing machine 410 is shown. The system 490 is utilized for transferring a charge 426 from a charging source 424 to a surface 414 of drum 412 which is adapted to receive a latent image 428 and for cleaning marking particles 430 and contamination 432 from the surface 414 of the drum 412. The cleaning and charging system 490 includes a frame 494 which is mounted to the printing machine 410. The cleaning and charging system 490 also includes a member 422 in the form of a blade similar to blade 22 of FIG. 1. The blade 422 is associated with the frame 474. The blade 422 is in contact with the surface 414 of the drum 412. The blade 422 is adapted to transfer the charge 426 from the charging source 424 to the surface 414. The blade 422 is also adapted to clean the marking particles 430 and the contamination 432 from the surface 414. The cleaning and the charging may thus be preformed simultaneously by the blade 422.

By providing a multi-function cleaning and charging member, the ozone emission from the printing machine may be reduced.

By providing a multi-function cleaning and charging member, a printing machine may be provided which is simpler, less expensive and easier and less expensive to manufacture and assemble.

By providing a cleaning and charging member which utilizes a blade to clean and to charge the photoconductive surface, the use of an expensive charging device such as a corotron or a bias charge roller is eliminated.

By providing a multi-function cleaning and charging blade, assembly time and cost may be reduced from the cost of the printing machine.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the invention.

What is claimed is:

1. A process cartridge for use in an electrostatographic printing machine for developing with marking particles a latent image, said process cartridge including:

a housing defining a chamber, the housing being selectively insertable into and detachable from the electrophotographic printing machine; aportion of the housing for storing a supply of marking particles therein;

an imaging member mounted within said housing and including a surface thereof adapted to receive a latent image;

a multifunctional member comprising a blade in a sliding and contacting relationship with the surface, at least a portion of the blade comprising an electrically conductive plastic, the blade mounted within the housing and operably associated with said imaging member for transferring a charge from a charging source to the surface of said imaging member and for cleaning at least one of marking particles and contamination from the surface of said imaging member; and an advancing member mounted within said housing for advancing the marking particles on a surface thereof from the chamber of said housing toward the surface of said imaging member.

2. A process cartridge as in claim 1, wherein said multifunctional member comprises a blade having a free edge.

3. A process cartridge as in claim 1, wherein at least a portion of said blade comprises urethane.

4. A process cartridge as in claim 3, wherein the portion of said blade includes an additive to assist conduction of electricity.

5. A process cartridge stem as in claim 1, wherein said blade comprises:

an electrically conductive metal body electrically connectable to the charging source and operably associated with said housing; and a flexible member extending from said body, said flexible member contactable with the surface.

6. A process cartridge as in claim 1, wherein said member is adapted to receive an electrical voltage of at least 1000 volts alternating current from the charging source.

7. A process cartridge as in claim 1, wherein the charging source is mounted within the housing.

* * * * *